United States Patent [19]

Wakaizumi et al.

[11] 4,126,525

[45] Nov. 21, 1978

[54] METHOD OF CONTROLLING FEED OF ALUMINA TO AN ALUMINUM ELECTROLYTIC CELL

[75] Inventors: Kiyoaki Wakaizumi; Toshiki Matsunaga; Yuji Mino, all of Kagawa, Japan

[73] Assignee: Mitsubishi Keikinzoku Kogyo Kabushiki Kaisha, Tokyo, Japan

[21] Appl. No.: 829,979

[22] Filed: Sep. 1, 1977

[30] Foreign Application Priority Data

Jun. 22, 1977 [JP] Japan ..... 52/74226

[51] Int. Cl.[2] ..... C25C 3/06; C25C 3/00

[52] U.S. Cl. ..... 204/67; 204/245

[58] Field of Search ..... 204/67, 245

[56] References Cited

U.S. PATENT DOCUMENTS

| | | | |
|---|---|---|---|
| 3,616,316 | 10/1971 | Dewey et al. | 204/67 |
| 3,622,475 | 11/1971 | Shiver et al. | 204/67 |
| 3,629,079 | 12/1977 | Bristol | 204/245 X |
| 4,035,251 | 7/1977 | Shiver et al. | 204/67 |

*Primary Examiner*—John H. Mack
*Assistant Examiner*—D. R. Valentine
*Attorney, Agent, or Firm*—Oblon, Fisher, Spivak, McClelland & Maier

[57] ABSTRACT

In a method of continuously feeding alumina to an aluminum electrolytic cell in which aluminum is prepared by the electrolysis of alumina, the feed of alumina is controlled by starting it when occurrence of an anode effect is detected or anticipated, and the feed is switched between high speed, low speed and interruption during each one of a series of cycles of operation.

6 Claims, No Drawings

METHOD OF CONTROLLING FEED OF ALUMINA TO AN ALUMINUM ELECTROLYTIC CELL

BACKGROUND OF THE INVENTION

This invention relates to a method of controlling alumina feed to an aluminum electrolytic cell, and more particularly a method of controlling alumina feed when alumina is fed continuously to the aluminium electrolytic bath. Especially, the invention relates to a method of controlling alumina feed capable of performing electrolytic operation at high efficiencies while preventing rapid change in the concentration of alumina in the electrolytic bath.

To prepare a aluminum at a commercial scale, alumina is electrolyzed in an electrolytic cell utilizing an electrolytic bath consisting mainly of cryolite, whereby alumina is reduced to aluminum metal.

During the normal operation of an aluminum electrolytic cell, the concentration of alumina in the electrolytic bath is generally maintained in a range of from 2 to 8% by weight. When the alumina concentration in the electrolytic bath exceeds its saturation value, the alumina in the bath deposits on the upper surface of the cathode electrode thus forming so-called sludge. The current efficiency of the electrolytic cell in which sludge has been formed decreases greatly and it takes a long time before normal state is resumed.

On the other hand, when the alumina concentration in the electrolytic bath decreases below a definite limit, the electrolytic bath per se undergoes electrolysis thus forming a gas film on the lower surface of the anode electrode immersed in the bath. When gas film builds up the interelectrode resistance increases, thus resulting in a so-called anode effect in which the electrolysis cell voltage increases rapidly. The cell voltage of a cell in which the anode effect occurred increases to about 30 to 40 volts which should be compared with the cell voltage of about 4 to 5 volts of a cell under normal operating condition, which means a large power loss. Such anode effect, however, can be eliminated by feeding alumina to the electrolytic cell, thus increasing the alumina concentration in the bath.

The anode effect does not present serious trouble because the normal condition can be resumed in a much shorter time than when sludge is formed. Accordingly, the electrolytic cell is generally operated over a range in which the alumina concentration is relatively low so as to prevent as far as possible the deposition of alumina.

The temperature of the electrolytic bath, however, is considerably high, of the order of 940° to 1000° C. and moreover since the alumina concentration in the bath varies with time, so it is difficult to control the alumina concentration by directly measuring the alumina concentration in the electrolytic bath.

Generally, the feed of alumina into the electrolytic bath is done either by breaking, at a definite interval, a suitable quantity of a crust of frozen electrolyte which is covering the bath, thereby causing the alumina to be forced into the bath together with broken crust to dissolve them in the bath or by continuously feeding a suitable quantity of alumina directly into the bath by an aluminum feeding device, thereby dissolving alumina.

According to these methods, however, as the alumina is fed independently of the alumina concentration of the electrolytic bath, there is a tendency of forming sludge due to excessive feed of alumina or of frequent occurrence of the anode effect due to deficient feed of alumina. Where the crust is broken at a definite interval for forcing and dissolving alumina into the bath, the alumina concentration of the bath varies greatly in a short time thus decreasing the current efficiency.

As a result of investigation made on the variation in the alumina concentration in an electrolytic bath during the electrolysis operation, we have found that, so long as the condition of electrolysis is substantially constant as is the case during normal operation, the alumina concentration in the electrolytic bath is substantially constant when anode effect occurs and that so long as the method of anticipating the anode effect is definite, the alumina concentration in the bath is also substantially constant at a time when the anode effect is anticipated. For example, according to a test result made on a prebake type aluminum electrolytic cell operating at an average anode current density of 0.72 $A/cm^2$, the alumina concentration in the electrolytic bath when anode effect occurs is always equal to $1.0 \pm 0.2\%$ whereas the alumina concentration is about $1.7 \pm 0.3\%$ when the occurrence of the anode effect is anticipated.

Based on these facts, according to this invention, alumina is fed continuously by taking as a reference the alumina concentration in the electrolytic bath when the occurrence of the anode effect is detected or anticipated and by taking into consideration the weighing errors of an alumina feeding device, thereby preventing rapid variation in the alumina concentration in the electrolytic cell as well as frequent occurrence of the anode effect and the formation of sludge.

SUMMARY OF THE INVENTION

Accordingly, it is an object of this invention to provide a method of efficiently operating an aluminum electrolytic cell.

Another object of this invention is to provide a novel method of continuously feeding alumina to an aluminum electrolytic cell.

Still another object of this invention is to provide a novel method of preventing rapid variations in the alumina concentration in an electrolytic cell.

A further object of this invention is to provide a method of feeding alumina to an aluminum electrolytic cell which can prevent formation of sludge and frequent occurrence of anode effect, thereby assuring stable and efficient operation of the cell.

According to this invention, these and other objects can be accomplished by providing a method of controlling feed of alumina to an aluminum electrolytic cell in which the alumina is electrolyzed to prepare aluminum, characterized in that the method comprises the steps of (a) commencing feed of alumina at a predetermined excess feed speed higher than a normal electrolysis speed of alumina by electrolysis when occurrence of an anode effect is detected or anticipated;

(b) switching the alumina feed speed to a predetermined normal feed speed which is substantially equal to the normal electrolysis speed when the alumina concentration in the electrolytic bath in said electrolytic cell which is calculated from the alumina concentration in the bath at the time of commencing the feed, the excess feed speed and the normal electrolysis speed reaches a predetermined reference concentration;

(c) interrupting the feed of alumina before an estimated maximum alumina concentration in the bath which is calculated from the alumina concentration in the bath at the time of commencing the feed, the predetermined feed speed of alumina, a feed error of alumina, and the normal electrolysis speed reaches a prescribed concentration limit, thereby causing the anode effect to occur or to be anticipated; and (d) feeding alumina by repeating a cycle of operation comprising the steps (a), (b) and (c) mentioned hereinbefore.

According to a modified method of this invention, the following additional steps are performed in each cycle.

(e) an estimated maximum value of a transition time between the interruption of feed of alumina and occurrence or anticipation of the anode effect is calculated from the predetermined feed speed of alumina, the feed error of alumina, feed time of alumina, and the normal electrolysis speed;

(f) an actual transition time is measured;

(g) the actual transition time is compared with the estimated maximum value of the transition time; and (h) the feed speed of alumina in the next cycle is set to a value lower than the predetermined feed speed when the actual transition time is longer than the estimated maximum value thereof and when the difference between them exceeds a predetermined permissible value.

DESCRIPTION OF THE PREFERRED EMBODIMENTS

According to this invention it is advantageous to maintain the alumina concentration in the electrolytic bath in a definite range for the purpose of preventing formation of sludge and generation of anode effect.

A preferred range of the alumina concentration is normally from 2 to 8%, preferably from 4 to 6%. According to the method of this invention, there is used a constant quantity alumina feeding device for feeding alumina to the electrolytic bath at an excess feed speed for increasing the alumina concentration in the bath to a predetermined reference concentration preset in said preferred range, and at a normal feed speed for continuously maintaining the alumina concentration at a definite value.

More particularly, upon detection or anticipation of the occurrence of the anode effect, the supply of alumina to the bath is commenced at the excess feed speed. Denoting the alumina concentration in the electrolytic bath at the time of commencing the feed by $C_o$ (%), the excess feed speed by $W_1$ (Kg/hr) and the set reference concentration by $C_1$ (%), the time required to reach the set reference concentration, that is the time (hr) in which alumina is fed at the excess feed speed is given by the following equation (1)

$$t_1 = \frac{0.01B(C_1 - C_o)}{W_1 - K \cdot I \cdot \eta} \quad (1)$$

where

*B:* weight of the electrolytic bath (Kg)

*I:* current (KA)

$\eta$: current efficiency (%)

*K:* constant ($6.33 \times 10^{-3}$ Kg/KA·hr).

It is advantageous to determine the excess feed speed such that the time $t_1$ will be equal to 1 to 3 hours.

When the calculated value of the alumina concentration in the bath reaches the set reference concentration $C_1$, the feed speed is switched to the normal feed speed $W_2$ (Kg/hr) given by the following equation (2) for continuing the alumina feeding $$W_2 = K \cdot I \cdot \eta \quad (2)$$

With this method, the alumina concentration in the bath would be maintained at the set reference concentration $C_1$ provided that the alumina feeding device is free from any weighing error but commercial feeding devices are inevitable to accompany a certain degree of weighing error.

Expressing the error per unit quantity of alumina fed by $\gamma$, even when the feed rate of alumina is set to W Kg/hr, the quantity of the alumina actually fed into the bath would vary in a range of $W(1 \pm \gamma)$ Kg/hr.

In accordance with this invention, in order to prevent formation of the sludge due to increase in the alumina concentration of the bath which in turn is caused by the error just described, the maximum time $t_2$(hr) during which the alumina is fed at the normal speed is calculated according to the following equation (3) for terminating the supply of alumina before the feed time $t_2$ expires in order to positively prevent formation of the sludge even when the actual weighing error of the feeding device is at the maximum value.

$$t_2 = \frac{0.01B(C_s - C_o) - [W_1(1 + \gamma) - K \cdot I \cdot \eta]t_1}{\gamma W_2} \quad (3)$$

where $C_s$ represents an alumina concentration limit permissible to prevent formation of the sludge. Although the alumina concentration that results in the formation of sludge varies depending upon the operating condition of the electrolytic cell it generally has a value in a range of from 9 to 11%. During the electrolysis operation various cell operations are performed including discharge of aluminum accumulated in the lower portion of the cell and exchange of a worn out anode electrode with a new one. During the cell operation, a portion of the alumina over the bath often drops and dissolves into the bath thereby increasing the alumina concentration thereof. The extent of rise of the alumina concentration is about 1 to 2% under normal operating conditions. Accordingly, in the method of feeding alumina described above, in order to positively prevent the formation of sludge it is advantageous to set the alumina concentration limit by taking into consideration this fact. For this reason, for the purpose of elongating as far as possible the time $t_2$ and preventing formation of sludge, it is desirable to set the concentration limit at a value of 1 to 2% lower than the alumina concentration at which sludge is formed and to continue feeding of alumina until time $t_2$ expires.

When the reference concentration $C_1$ of alumina is set at a low value and where the error of the alumina feeding device is negative, the alumina concentration in the bath decreases gradually during the feeding of alumina at the normal feed speed, thus resulting in the anode effect. In such a case it is necessary to switch the feed speed to the excess feed speed by taking the anode effect or anticipation thereof as a start signal for commencing the feed of alumina.

However, generation of the anode effect during the feeding of alumina should be avoided because this means that the alumina concentration of the bath is varied considerably within a short time. For this reason, it is advantageous to set the reference concentration $C_1$ of alumina in a range of from 4 to 6% as above described.

Upon interruption of alumina feeding, the alumina concentration in the bath decreases gradually until finally the anode effect occurs or can be anticipated.

The recognition of the occurrence of the anode effect can be made, for example, by detecting the fact that the cell voltage has reached to a predetermined value selected in a range of from 8 to 40 V. Various methods of anticipating the anode effect have been proposed, and in this invention any one of them may be selected. Typical methods of anticipating the anode effect are described, for example, in British Pat. No. 1,242,280 and U.S. Pat. Nos. 3,573,179, 3,625,842 and 3,712,857 and Japanese patent publication No. 40005/76.

So long as the same method of recognition is relied upon, the alumina concentration in the bath at the time of generation or anticipation of the anode effect is substantially constant as above described so that once analysis is made in conformity with the operating condition, it is not necessary to repeat the analysis each time the anode effect occurs.

When the occurrence of the anode effect is detected or anticipated, feed of alumina is commenced again.

By the above described method of control it is possible to prevent rapid change in the alumina concentration in the electrolysis bath during the operation of the prebake type or Söderberg type aluminum electrolytic cell or to prevent formation of sludge thus making it possible to control the operation of the aluminum electrolytic cell at high current efficiencies.

However, the electrolytic reaction in the electrolytic cell sometimes becomes abnormal and we have investigated how to modify the control method so as to be suitable for such abnormal condition.

For example, where the electrolysis reaction becomes abnormal due to short circuiting of the anode electrode, the current efficiency decreases. In this case, as the speed of consuming alumina caused by electrolysis decreases the alumina concentration in the bath increases and finally goes beyond the concentration at which sludge is formed thus forming sludge in the molten aluminum. If this condition is allowed to persist the current efficiency decreases further to enhance the formation of the sludge.

For this reason, it is essential to detect the abnormal condition of the reaction at an early stage for correcting the same. However, it is extremely difficult to efficiently measure the instantaneous value of the current efficiency for detecting the abnormal condition. Heretofore, the abnormal reaction has been detected by observing such factors as the variation in the height of the molten aluminum in the cell (the apparent volume of the molten aluminum is increased by the formation of sludge with the result that the height of the molten aluminum in the cell increases), the color of the bath, and the frequency of the anode effect. However, accurate judgement can be made only by skilled operators, yet accompanies personal error.

As the result of our research we have found that the interval between the interruption of the alumina feed and the detection or anticipation of the anode effect can be used as a measure of the abnormal reaction, thus rendering more accurate the control.

As above described the modified method of controlling the continuous feed of alumina of this invention comprises the steps of (a) commencing the feed of alumina at a prescribed speed (excess feed speed) which is higher than the consumption speed (normal electrolysis speed) of alumina due to normal electrolysis when the occurrence of the anode effect is detected or anticipated, (b) switching the alumina feed speed to a prescribed feed speed (normal feed speed) which is substantially equal to the normal electrolysis speed when the alumina concentration in the electrolysis bath which is calculated from the alumina concentration in the bath at the time of commencing feed, the excess feed speed and the normal electrolysis speed reaches a preset reference concentration, and (c) interrupting the feed of alumina before an estimated maximum alumina concentration in the bath which is calculated from the alumina concentration in the bath at the time of commencing the feed, the prescribed feed speed of alumina, feed error of alumina and the normal electrolysis speed reaches a prescribed concentration limit, the steps (a), (b) and (c) constituting one cycle of control, and characterized in that in each cycle (d) an estimated maximum value of the interval (transition time) between the interruption of the feed of alumina and the detection or anticipation of the anode effect is calculated from the preset feed speed of alumina, the feed error of alumina, alumina feed time and the normal electrolysis speed, (e) the actual transition time is measured, (f) the actual transition time is compared with the estimated maximum value of the transition time, and (g) the prescribed feed speed of alumina in the next cycle is set to a lower speed where the actual transition time is longer than the estimated maximum value of the transition time and when their difference is larger than a predetermined permissible value.

The modified method of control will now be described in detail.

More particularly, so long as the electrolysis reaction is normal the current efficiency $\eta$ is substantially constant so that the transition time $T(\gamma\cdot\eta)$ can be calculated by the following equation (4) where $\gamma$ represents the feed error and $\eta$ the current efficiency.

$$T(\gamma\cdot\eta) = \frac{\{W_1(1\pm\gamma) - KI\eta\}t_1 + \{W_2(1\pm\gamma) - KI\eta\}t_2}{KI\eta} = \frac{(W_1 - KI\eta)t_1}{KI\eta} \pm \frac{(W_1t_1 + W_2t_2)\gamma}{KI\eta} \quad (4)$$

putting $$T(0\cdot\eta) = \frac{(W_1 - KI\eta)t_1}{KI\eta} \quad (5)$$

$$\Delta T^1(\gamma\cdot\eta) = \frac{(W_1t_1 + W_2t_2)\gamma}{KI\eta} \quad (6)$$

Then, $$T(\gamma\cdot\eta) = T(0\cdot\eta) \pm \Delta T^1(\gamma\cdot\eta) \quad (7)$$

where $T(0\cdot\eta) + \Delta T^1(\gamma\cdot\eta)$ represents the estimated maximum value of the transition time.

Therefore, it can be judged that the reaction is normal so long as the actual transition time is included in a range defined by the following equation (8).

$$T(0\cdot\eta) - \Delta T^1(\gamma\cdot\eta) \leqq T \leqq T(0\cdot\eta) + \Delta T^1(\gamma\cdot\eta) \quad (8)$$

Where one of the cell operations described above is performed during the feeding of alumina, the transition time $T^1(\gamma\cdot\eta)$ can be given by the following equation (9) where $\Delta C(\%)$ represents the increment of the alumina concentration caused by the cell operation.

$$T^1(\gamma\cdot\eta) = T(\gamma\cdot\eta) + \frac{0.01B\cdot\Delta C}{KI\eta} \quad (9)$$
$$= T(0\cdot\eta) \pm \Delta T^1(\gamma\cdot\eta) + \frac{0.01B\cdot\Delta C}{KI\eta}$$

However, since the effect of the cell operation can readily be corrected, let us proceed with equation (7) as the basis by neglecting the effect of the cell operation.

Suppose now that the electrolysis reaction becomes abnormal so that the current efficiency decreases from $\eta$ to $\eta - \Delta\eta$, on the average, the transition time $T(\gamma\cdot\eta - \Delta\eta)$ can be calculated as follows.

$$T(\gamma\cdot\eta - \Delta\eta) = \quad (10)$$
$$\frac{\{W_1(1\pm\gamma) - KI(\eta-\Delta\eta)\}t_1 + \{W_2(1\pm\gamma) - KI(\eta-\Delta\eta)\}t_2}{KI(\eta-\Delta\eta)}$$
$$= \frac{(W_1 - KI\eta)t_1}{KI\eta} \pm \frac{(W_1t_1 + W_2t_2)\gamma}{KI\eta} + \frac{\Delta\eta(W_1t_1 + W_2t_2)(1\pm\gamma)}{KI\eta(\eta-\Delta\eta)}$$

Putting now $$\Delta T^2(\gamma\cdot\eta\cdot\Delta\eta) = \frac{\Delta\eta(W_1t_1 + W_2t_2)(1\pm\gamma)}{KI\eta(\eta-\Delta\eta)} \quad (11)$$

we obtain $$T(\gamma\cdot\eta - \Delta\eta) = T(0\cdot\eta) \pm \Delta T^1(\gamma\cdot\eta) + \Delta T^2(\gamma\cdot\eta, \Delta\eta) \quad (12)$$

Consequently, where the actual transition time $T$ exceeds the estimated maximum value thereof, that is where $$T > T(0\cdot\eta) + \Delta T^1(\gamma\cdot\eta) \quad (13)$$

it can be presumed that the current efficiency has decreased.

Accordingly, an allowable value $T_A$ for the control is preset and in a case expressed by the following equation (14)

$$T \geqq T(0\cdot\eta) + \Delta T^1(\gamma\cdot\eta) + T_A \quad (14)$$

the feed speed of alumina in the next cycle is set to a lower value so as to avoid a vicious cycle described above caused by the formation of sludge.

The permissible value $T_A$ is set by taking the value of $\Delta T^2(\gamma\cdot\eta\cdot\Delta\eta)$ as a reference. Thus, it is advantageous to use as the preset permissible value $T_A$ the value of $\Delta T^2(\gamma\cdot\eta\cdot\Delta\eta)$ which is determined by using the value of $\Delta\eta = 2 \sim 6\%$ as the permissible limit and by substituting this value into equation (11) together with the other conditions of electrolysis. If the permissible value of $\Delta\eta$ were too large, detection of the abnormal condition will be delayed, whereas if too small, correction would be made before the abnormal condition actually appears thus delaying electrolysis. For this reason, it is preferable to preset $\Delta\eta$ in the above described range.

The feed speed of alumina may be reduced by reducing both of the excess feed speed $W_1$ and the normal feed speed $W_2$. However, where the time $t_1$ in which the alumina is fed at the excess feed speed is short, since the effect of the excess feed speed is small, usually it is sufficient to reduce only the normal feed speed.

It is advantageous to determine the percentage reduction of the set feed speed in accordance with the decrease in the current efficiency but since it is difficult to have an accurate evaluation it is generally preferable to set the percentage reduction in a range of from 10 to 20%. With a reduction rate of more than 20% the quantity of alumina fed is often reduced by a percentage higher than the percentage of reduction of the current efficiency with the result that the alumina concentration in the electrolytic cell decreases thus causing the frequent occurrence of anode effect. With a percentage reduction of less than 10%, it is usually difficult to overcome the decrease in the current efficiency in the abnormal condition. For this reason, it is preferable to set the percentage reduction in the above described range.

In addition to setting the alumina feed speed at a lower value, it is advantageous to supervise the abnormal condition of the electrolytic cell by giving an alarm when a condition expressed by equation (14) occurs.

The recovery of a normal cell condition is easily judged by observing the shortening of transition time or the occurrence of anode effect during the feeding of alumina and then the reduced alumina feed speed is returned to the original value. It is advantageous to return the alumina feed speed gradually in accordance with the recovery of the cell condition.

By using the modified control method described above it is possible to detect the abnormal condition of the electrolytic reaction at an early stage thereof and to prevent its growth by a suitable correction operation by detecting the decrease in the current efficiency.

In carrying out the method according to this invention, it is not indispensable but convenient to utilize a programmed control device such as a ditigal computer.

To have better understanding of this invention, the following examples are illustrated but it should be understood that the invention is by no means limited to these specific examples.

EXAMPLE 1

In a pre-bake type aluminum electrolytic cell having a rated cell current of 135 KA and an average anode current density of 0.72 A/cm$^2$ the alumina concentration ($C_o$) in the electrolytic bath when an anode effect occurred (judged by the fact that the cell voltage reaches 8 volts) was measured by chemical analysis and found to be 1.0%.

The quantity of the electrolytic bath was about 5,000 Kg, the current efficiency was 89%, average increase in the alumina concentration in the bath caused by the cell operation was about 1%, and the alumina concentration at which sludge was formed was about 9%. Therefore, the normal electrolysis speed in the cell was 76 Kg/hr.

By setting a reference alumina concentration ($C_1$) to 4.9% and a concentration limit ($C_s$) to 8%, alumina was fed by using a feeding device having an error ($\gamma$) of 0.07.

Upon detection of an anode effect, feed of alumina was commenced by setting the feed speed ($W_1$) of the alumina feeding device to 152 Kg/hr which is equal to twice of the normal electrolysis speed and feeding of alumina was continued for 2.6 hours ($t_1$). After changing the feed speed ($W_2$) of the feeding device to 76 kg/hr, the feed was continued. As the time $t_2$ calculated by equation (3) is 20.4 hours, supply of alumina was interrupted after 17.4 to 20.4 hours. The generation of the anode effect was detected again 1 to 4 hours after interruption of alumina feed and the operation described above was repeated.

The result of operation for 180 days showed that the generation of the anode effect was once per day on the average and formation of sludge was not noted.

EXAMPLE 2

In a pre-bake type aluminum electrolytic cell having rated cell current of 135 KA, the alumina concentration in the electrolytic bath when an anode effect occurred (judged by the fact that the cell voltage has reached 8 volts) was measured by chemical analysis and found to be 1.0%.

The quantity of the electrolytic bath was about 5,000 Kg, normal current efficiency was 89%, and the average increase in the alumina concentration in the bath due to the electrolytic cell operation (including anode exchange) was about 1%. Accordingly, the normal electrolysis speed of this cell was 76 Kg/hr.

By setting the alumina reference concentration ($C_1$) to 4.0% and the concentration limit ($C_s$) to 7%, alumina was fed by an alumina feeding device having an error ($\gamma$) of 0.05.

Upon detection of the occurrence of an anode effect feed of alumina was commenced by setting the feed speed ($W_1$) of the alumina feeding device to 151 Kg/hr which is equal to about twice of the normal electrolysis speed and alumina feed was continued for about 2 hours ($t_1$).

After changing the feed speed ($W_2$) of the alumina feeding device to 76 Kg/hr, feed of alumina was continued for 20 hours ($t_2$) (the value of $t_2$ calculated by equation (3) is 37 hours).

Where the reaction is normal, the transition time T(hr) calculated by equation (8) is expressed by an equation $0.8 \leqq T \leqq 3.2$. The permissible value $T_A$ was set to 0.9 hour (calculated by equation (11) by assuming $\Delta\eta = 3\%$). When the transition time became $T \geqq 4.1$ (hr) ($= 3.2 + 0.9$), the abnormal condition was detected and a control system (computer) produced an alarm. Concurrently therewith, the normal feed speed ($W_2$) of the next cycle was reduced 20%, that is to 61 Kg/hr for the purpose of avoiding excess feed.

Although abnormal reactions occurred during operation due to short circuiting of the anode electrode by detecting the fact that the transition time T has exceeded 4.1 hours such abnormal reactions could be found within only one day. Furthermore, since the feed speed of alumina was reduced as above described no sludge was formed so that it was possible to resume normal operation in only 2 days instead of about one half month of the prior art method.

We claim:

1. A method of controlling feed of alumina to an aluminum electrolytic cell in which the alumina is electrolyzed to prepare aluminum, said method comprising the steps of (a) commencing feed of alumina at a predetermined excess feed rate higher than the normal rate of consumption of alumina by electrolysis in said cell when the occurrence of an anode effect is detected or anticipated, and continuing feeding at said excess feed rate for a time $t_1$ calculated to correspond to the time necessary for the alumina concentration in said cell to reach a predetermined desirable level, wherein said time $t_1$ is calculated based on the measured alumina concentration when said feeding is commenced, said excess feed rate, and said normal rate of consumption of alumina;

(b) switching the alumina feed rate when said time $t_1$ has elapsed to a predetermined normal feed rate which is substantially equal to said normal rate of consumption of alumina, and continuing feeding at said normal feed rate for not longer than a time $t_2$ calculated to correspond substantially to the maximum time said feeding at said normal feed rate may continue before the alumina concentration reaches a predetermined maximum permissible concentration limit necessary to prevent formation of sludge, wherein said time $t_2$ is calculated based on said measured alumina concentration when said feeding is commenced in step (a), said predetermined excess feed rate, said normal feed rate, and the maximum positive feed error;

(c) interrupting the feed of alumina before or when said time $t_2$ has elapsed, thereby causing an anode effect to occur or to be anticipated; and (d) maintaining said cell in operation by repetition of the cycle comprising said steps (a), (b) and (c).

2. The method according to claim 1 wherein said predetermined desirable level for the concentration of alumina in step (a) ranges from 2 to 8%.

3. The method according to claim 2 wherein said predetermined desirable level ranges from 4 to 6%.

4. The method according to claim 1 wherein said excess feed rate is selected such that said time $t_1$ is from 1 to 3 hours.

5. A method of controlling feed of alumina to an aluminum electrolytic cell in which the alumina is electrolyzed to prepare aluminum, said method comprising the steps of (a) commencing feed of alumina at a predetermined excess feed rate higher than the normal rate of consumption of alumina by electrolysis in said cell when the occurrence of an anode effect is detected or anticipated, and continuing feeding at said excess feed rate for a time $t_1$ calculated to correspond to the time necessary for the alumina concentration in said cell to reach a predetermined desirable level, wherein said time $t_1$ is calculated based on the measured alumina concentration when said feeding is commenced, said excess feed rate, and said normal rate of consumption of alumina;

(b) switching the alumina feed rate when said time $t_1$ has elapsed to a predetermined normal feed rate which is substantially equal to said normmal rate of consumption of alumina, and continuing feeding at said normal feed rate for not longer than a time $t_2$ calculated to correspond substantially to the maximum time said feeding at said normal feed rate may continue before the alumina concentration reaches a predetermined maximum permissible concentration limit necessary to prevent formation of sludge, wherein said time $t_2$ is calculated based on said measured alumina concentration when said feeding is commenced in step (a), said predetermined excess feed rate, said normal feed rate, and the maximum positive feed error;

(c) interrupting the feed of alumina before or when said time $t_2$ has elapsed, thereby causing an anode effect to occur or to be anticipated; and (d) maintaining said cell in operation by repetition of the cycle comprising said steps (a), (b) and (c); and in each cycle (e) calculating an estimated maximum value of the transition time $T$ between said interruption of feed of alumina and occurrence or anticipation of said anode effect, based on said excess feed rate, said normal feed rate, said maximum positive feed error, said times $t_1$ and $t_2$, and said normal rate of consumption of alumina;

(f) measuring an actual transition time;

(g) comparing said actual transition time with said estimated maximum value $T$ of the transition time; and (h) setting at least one of the feed rates of alumina in the next cycle to a value lower than said predetermined feed rate when said actual transition time $T$ is longer than said estimated maximum value thereof and when the difference between them exceeds a predetermined permissible value.

6. The method according to claim 5 wherein said predetermined feed rate is reduced by from 10 to 20% in said next cycle.

* * * * *